US005711657A

United States Patent [19]

Hoffmeier

[11] Patent Number: 5,711,657

[45] Date of Patent: Jan. 27, 1998

[54] CENTRIFUGAL PUMP, PARTICULARLY FOR FOUNTAINS

[75] Inventor: Dieter Hoffmeier, Ibbenbucren, Germany

[73] Assignee: Oase-Pumpen Wuebker Soehne GmbH & Co. Maschinenfabrik, Hoerstel, Germany

[21] Appl. No.: 615,212

[22] PCT Filed: Jul. 14, 1995

[86] PCT No.: PCT/EP95/02770

§ 371 Date: Mar. 13, 1996

§ 102(e) Date: Mar. 13, 1996

[87] PCT Pub. No.: WO96/02763

PCT Pub. Date: Feb. 1, 1996

[30] Foreign Application Priority Data

Jul. 15, 1994 [DE] Germany ..... 44 24 996.9

[51] Int. Cl.[6] ..... F04D 29/24; F04D 13/02

[52] U.S. Cl. ..... 417/319; 415/141; 417/423.7

[58] Field of Search ..... 415/141; 416/235; 417/423.7, 319

[56] References Cited

U.S. PATENT DOCUMENTS

| | | | |
|---|---|---|---|
| 2,684,035 | 7/1954 | Kemp | 415/141 X |
| 2,899,902 | 8/1959 | Bandli et al. | 415/141 X |
| 2,986,095 | 5/1961 | Namar | 415/141 X |
| 3,510,229 | 5/1970 | Smith | 415/141 X |
| 4,008,985 | 2/1977 | Schemmann et al. | 415/141 X |
| 4,755,105 | 7/1988 | Blakeslee et al. | 415/141 |
| 4,861,468 | 8/1989 | Willinger et al. | 210/169 |

FOREIGN PATENT DOCUMENTS

| | | |
|---|---|---|
| 320060 | 6/1987 | European Pat. Off. . |
| 1104923 | 11/1955 | France . |
| 2138083 | 12/1972 | France . |

*Primary Examiner*—Richard E. Gluck
*Attorney, Agent, or Firm*—Jordan and Hamburg

[57] ABSTRACT

A centrifugal pump, particularly for fountains and aquariums, for which an electric motor and a pump are disposed coaxially to one another, the electric motor being constructed as a single-phase synchronous motor with a permanent magnet rotor and connected with an open impeller of the pump with impeller blades, which are bent back from a hub towards the outside spirally with respect to a specified direction of rotation, is improved in the direction of a simple and inexpensive production as well as a compact and robust construction without a significant loss in overall efficiency owing to the fact that the impeller blades are constructed flexibly in such a manner that, if the synchronous motor starts counter to the specified direction of rotation, they are propped open by at least 2% in the radial length.

18 Claims, 3 Drawing Sheets

Fig.4
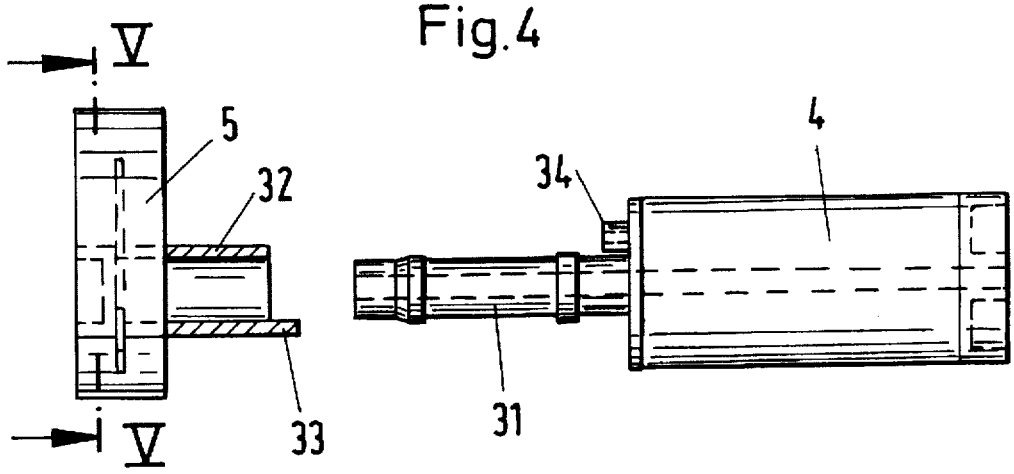
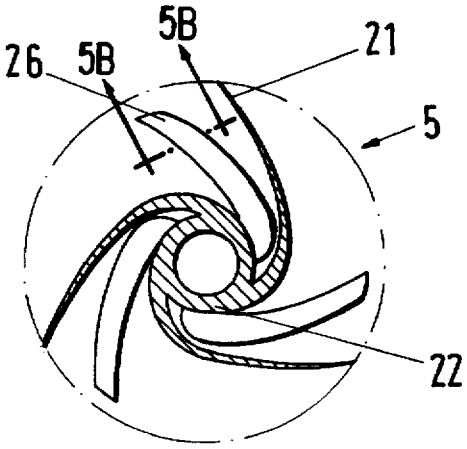
Fig.5A
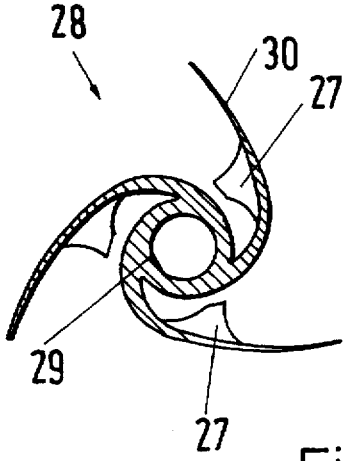
Fig.6
Fig.7A
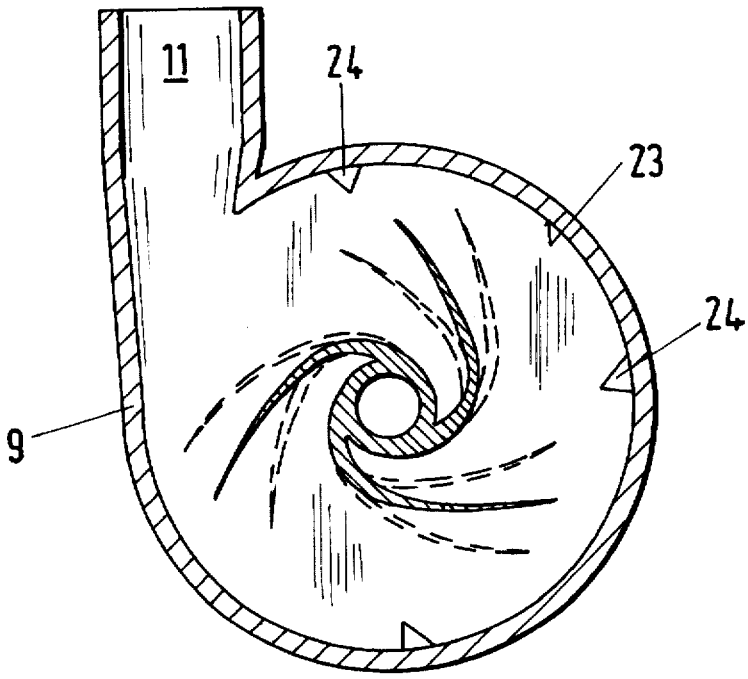

CENTRIFUGAL PUMP, PARTICULARLY FOR FOUNTAINS

BACKGROUND OF THE INVENTION

The invention relates to a centrifugal pump, particularly for fountains and aquariums.

Known pumps of this type are equipped with a single-phase synchronous electric motor with a synchro-generator winding in the stator, which sees to it that the motor starts in the specified direction of rotation. Since the specified direction of rotation of the motor is ensured, it is also possible to use an impeller, which depends on the direction of rotation. A higher degree of hydraulic efficiency can be achieved with spiral-shaped impeller blades than with a rotation-dependent impeller with radially-extending impeller blades. However, the impeller-related advantages achieved, which are reflected in the motor power required, the manufacturing costs and the overall size, are partly offset by the costs of the auxiliary winding circuit in the stator. Especially in the area of smaller pumps for use within the home and garden, not only the possibility for connecting to a single-phase power supply, but also the need for an extremely inexpensive and compact construction should be taken into consideration.

SUMMARY OF THE INVENTION

It is therefore an object of the invention to provide a centrifugal pump, which is distinguished because it can be produced simply and inexpensively and is compact and robust without a significant loss in overall efficiency.

The inventive solution provides for the use of a single-phase synchronous motor with a permanent magnet rotor without any additional auxiliary winding as the driving mechanism. The direction, in which such a motor starts, is fixed by the reaction of the impeller. This is made possible by means of constructing the spiral-shaped impeller blades flexibly in such a way that, when the single-phase synchronous motor starts in the direction opposite to the specified direction of rotation of the spiral-shaped impeller, the impeller blades prop open in the radial length. Since, on the one hand, the direction of rotation of the impeller is "open" depending on the starting direction of such a single-phase, synchronous motor and, on the other, a useful hydraulic efficiency can be achieved by a spirally-shaped impeller only if the "correct" direction of the impeller is maintained, the invention provides that the impeller itself selects the "correct" direction of rotation. If the motor initially starts counter to the correct direction of rotation or hunts against the correct direction of rotation when starting up, the impeller blades stand up, as a result of which the water resistance is increased significantly and the motor is decelerated. With the tendency of the single-phase synchronous motor to hunt when starting up and with the preferred direction of rotation determined by the impeller, the motor is fore, ed to start in the correct direction of rotation.

Further details and advantages of the invention arise out of the following description and the accompanying drawings.

BRIEF DESCRIPTION OF THE DRAWINGS

FIG. 4 shows a side view of the rotor and impeller of the centrifugal pump of FIGS. 1 to 3, axially pulled apart, FIG. 5A shows a section along the line V—V of FIG. 4, FIG. 6 shows a further embodiment of an impeller in a sectional view corresponding to that of FIG. 5, and FIG. 7A shows a sectional view of a third embodiment of an impeller in sectional view, similar to that of FIGS. 5 and 6, together with an associated pump housing.

BRIEF DESCRIPTION OF THE DRAWINGS

Figure 1:
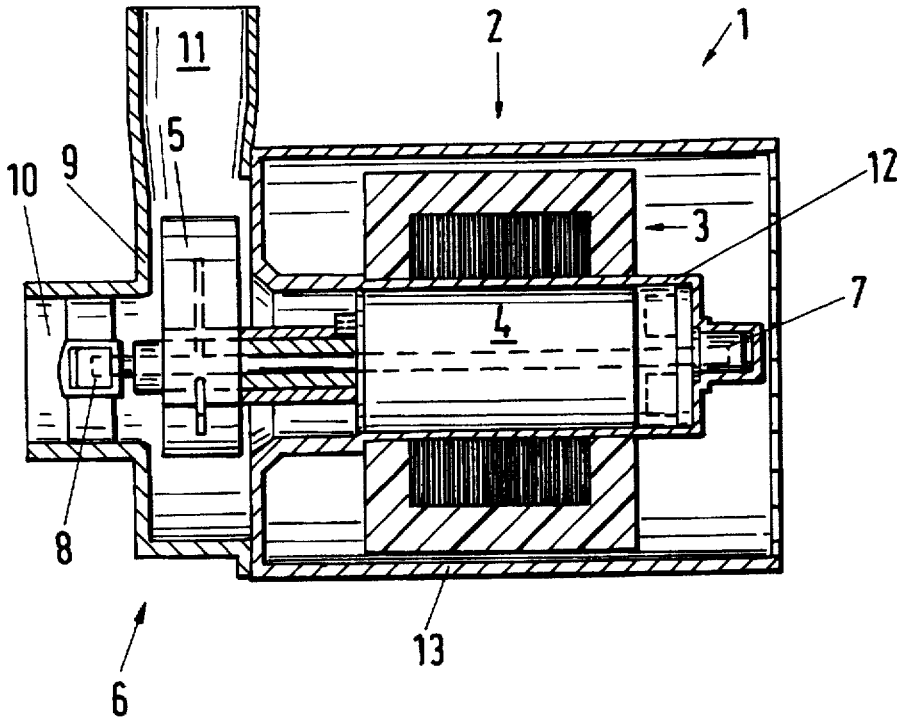
FIG. 1 shows a longitudinal section through a centrifugal pump.

The centrifugal pump, shown as a whole in longitudinal section in FIG. 1 and labeled 1, comprises a single-phase induction motor 2 with an external stator 3 and an internal, rotatably mounted, permanent magnet rotor 4, which is connected axially with an impeller 5 with a pump part 6 and mounted between two bearings, namely a closed bearing 7 on the motor side and a closed bearing 8 on the pump side. The latter is held in a spiral housing 9 of the pump part 6 and, moreover, centrally in an axial inlet in the form of a suction duct 10, through which the liquid, which is to be pumped, such as the water of a fountain, is moved centrifugally with the help of the impeller 5 to an outlet in the form of a pressure pipe joint 11, which is constructed in the form of a diffuser with a slight conical expansion, in order to recover a higher pressure with little loss from the flow energy of the liquid in the pump.

The electric motor 2 of the centrifugal pump is a single-phase synchronous motor, the permanent magnet rotor making it possible to do without transferring current to the rotor and, with that, to brushes, rotor slip rings and commutators. With that, the basic concept of a canned motor with a can 12 becomes possible. The can 12 is watertight and surrounds the rotor 4 and the closed bearing 7 and, towards the pump part 6 towards the outside of a ring-shaped end wall, goes over into an outer part of a pump housing. After all, only the stator 3 is connected to a source of alternating current; at the same time, however, it is sealed on the inside and the outside by the can 12 and the outer housing 13. Moreover, the regions, which still remain exposed, are lined with epoxide resin so that high electrical safety is ensured.

Evidently, this embodiment of a single-phase induction motor not only is exceedingly safe electrically but also is installation-friendly with respect to the centrifugal pumps, since the rotor 4 and the impeller 5 can be inserted from the open side of the can 12 facing the pump part 6, after which the spiral housing is mounted in position also in the axial direction. The preferred embodiment of the housing of plastic with a possibility of using largely screwless connections, especially the possibility of plug-in and lock connections, results in an extremely easy and rapid installation.

Figure 2:
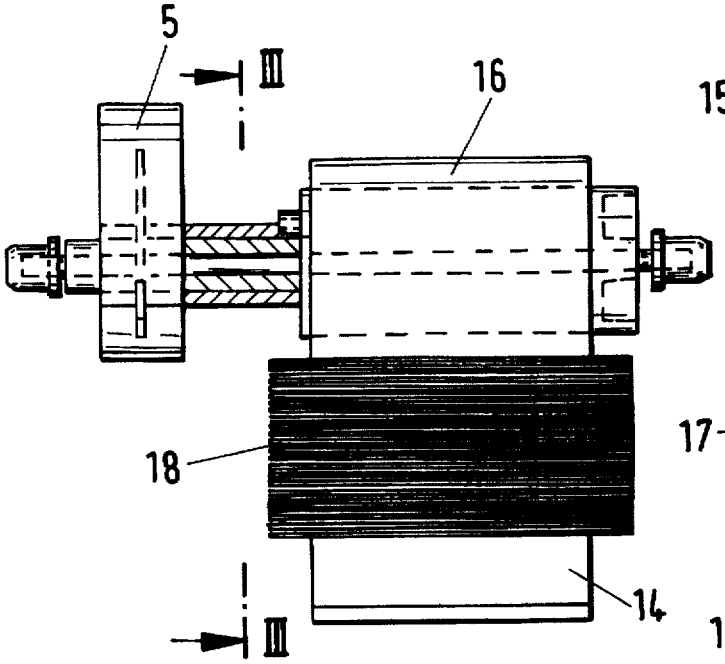
FIG. 2 shows a plan view of the motor and pump impeller of the centrifugal pump of FIG. 1 without motor and pump housing.
Figure 3:
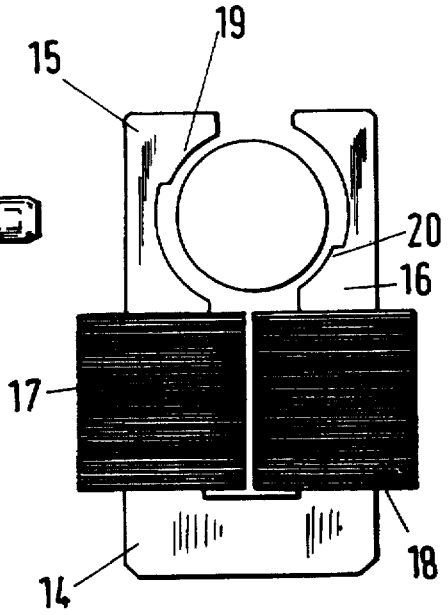
FIG. 3 shows a sectional view along the line III—III of FIG. 2.

With respect to the construction of the stator 3, it can be seen even more clearly in FIGS. 2 and 3 that this stator 3 comprises a U-shaped bundle of laminations 14 with two elongated legs 15 and 16, each of which carries one half 17, 18 of the winding of the motor and, at the end, embraces an essentially cylindrical opening, within which the can 12 (not shown) and the rotor 4 are located. It can be seen from FIG. 3 that the bundle of laminations 14 does not surround the rotor with pole piece surfaces, which are precisely cylindrical. Instead, with regions 19, 20, which are mutually opposite to one another but are disposed asymmetrically to the bundle of laminations 14, the bundle of laminations forms a magnet gap, which emphasizes an edge position in relation to the pole piece formation of the legs 15, 16. This has proven its value with respect to the basically critical starting of the single-phase induction motor, since the permanent magnet rotor is aligned asymmetrically at rest and, when the motor is switched on, lies outside of the neutral central position. With this, the starting of the rotor generally is facilitated.

In relation to a direction of rotation-dependent construction of the pump part with directionally related matching of the impeller 5 to the spiral housing 9, a particular direction of rotation of the motor is absolutely necessary. Pursuant to the invention, reliability in this respect is provided by the impeller 5, which is equipped with impeller blades 21, which prop open flexibly if the synchronous motor starts "wrongly" counter to the specified direction of rotation. Conventionally, deformation of such impellers is undesirable. It can be brought about structurally by a general flexibility of the material of construction and/or by a selective configuration of the cross section of the impeller blades, particularly towards a central region in the vicinity of a hub 22.

A barrier against a "wrong" start can be achieved basically already owing to the fat that, when the motor runs backwards, the impeller, which props open, forms a flow resistance, at which the single-phase induction motor slips out of step and changes over into a hunting motion, from which it then, possibly after further attempts, reaches a forward start. At the same time, in each direction of rotation, a gap is maintained between the impeller blades and the pump housing.

Figure 7B:
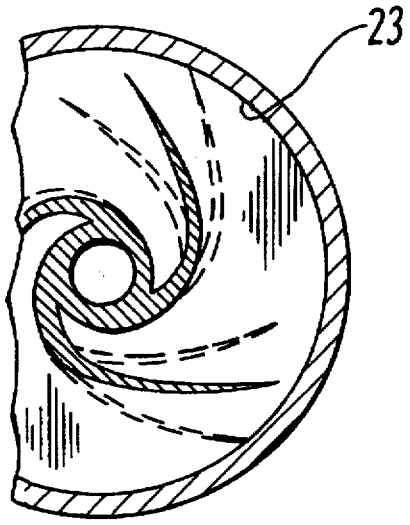
FIGS. 7B and 7C are partial sectional views similar to FIG. 7A showing other relative positions of the impeller.
Figure 7C:
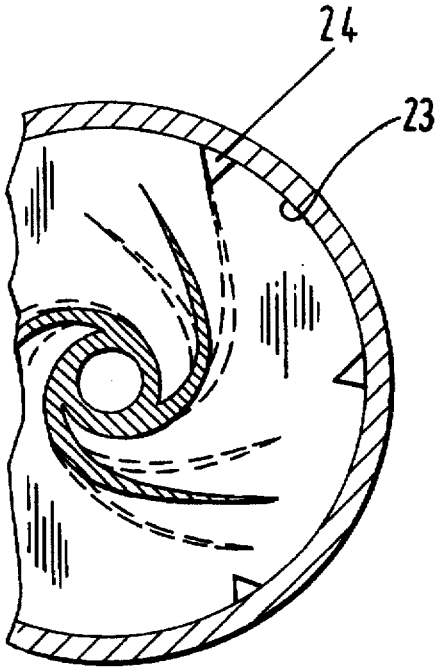

The impeller may, however, also be designed in such a manner with respect to the spiral housing 9, that the ends of the impeller blades, when propped open because the motor is running in the wrong direction, collide with a peripheral inner wall 23 of the spiral housing (FIG. 7B) or also with inwardly protruding stationary parts on this housing, such as rib-like or fin-like stops 24 (FIG. 7C). In FIG. 7A aside from the cross-hatched surface of the impeller 25, the propped open form of the impeller 25, when the motor is running backwards and the shape of the impeller blades when the motor is running forward, which shape is curved relative to the position at rest, are also drawn by broken lines.

A propping open of the impeller blades from about 2% radial length, that is, the (radial) distance of the ends of the impeller blades from the associated axle, can increase the flow resistance to such an extent already when the motor is running backwards, that the driving single-phase induction motor does not attain a synchronous start. Such a limited propping open can likewise suffice to bring together the impeller blades and the stops and, with that, stop a "wrong" start. Preferably, the impeller blades are designed to prop open by 5 to 10% when the motor is running backwards.

A flexible construction and/or articulation of the impeller blades creates effects, which are dependent not only on the direction of rotation but also on the load. Previously known impeller blades with a rigid sickle shape (at a fixed, specified rpm) perform well and offer a good efficiency only in a very limited middle range of pumping height and throughput. On the other hand, the inventive, flexible impeller blades achieve a good performance and a high efficiency over wide working ranges of pumping height and throughput. Moreover, contrary to what is the case with conventional pumps, the performance, which is required from and must be provided by the synchronous motor, is approximately constant over the whole range, that is, in the limiting region with maximum pumping height (throughput 0) as well as in the limiting region with maximum throughput (pumping height 0) and the middle working ranges and thus fits in well with the performance characteristics of the synchronous motor. Overall, this leads to a very good performance within the confines of the given overall height.

Moreover, the motor runs particularly quietly over the whole performance range of the pump. Full load operation can be ensured, particularly due to the continuously high load on the motor, which depends hardly at all on the load on the motor resulting from the pumping height and throughput. By these means, operation under a partial load, at which particularly single-phase synchronous motors tend to oscillate strongly and produce vibrations and noise, which penetrate to the outside, is avoided. These properties stand out particularly in the ease of small and simple motor pumps of the type, which comes into question here.

Figure 5B:
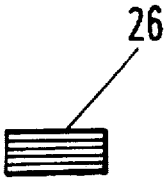
FIG. 5B shows a section taken along the line 5B—5B of FIG. 5A.

In the event that the flexible construction of the impeller blades for propping open during the reverse motion of the motor leads to an undesirably strong deformation during the forwards motion of the motor, the blades can be stabilized by spacers. In FIGS. 5A and 5B, spacers 26 are illustrated, which extend swordlike in a central radial plane, thus have little effect on the flow in the pump part and support the blades, when they are bent back under a load.

A similar effect can be achieved with spacers 27 in the case of an impeller 28 of FIG. 6. These spacers 27 are not attached to an impeller hub 29, but are attached as backward fins to the impeller blades 30.

As is illustrated particularly by FIGS. 1, 2 and 4, torque is transferred between the rotor 4 and the impeller 5 with the help of a freewheel clutch, for which a coaxially arranged stub shaft 31 and an engaging sleeve 32 are brought together so as to lock. The engaging sleeves 32 can be twisted freely to such an extent relative to the shaft 31 over an angular range of more than 120° here in either direction, until an engaging dog 33 on the sleeve 32 comes up on the one or the other side against an engaging stop 34, which rotates with the shaft 31. The therewith created freewheeling can in many cases be useful in facilitating the tricky start of the single-phase induction motor, since this starting does not take place under load. However, it has turned out that, by suitably designing the impeller with the flexible impeller blades, a starting in the forwards direction is promoted, which frequently makes it possible to do without such freewheeling. The latter is an important manufacturing advantage particularly in the case of mass production involving the use of the least possible number of parts, particularly injection-molded plastic parts, and when a simple installation and short installation time are required.

I claim:

1. Pump apparatus comprising a centrifugal pump, an electric motor axially aligned with said centrifugal pump, said electric motor comprising a single-phase synchronous motor having a permanent magnet rotor, said centrifugal pump comprising a housing and an impeller rotatable in said housing, said impeller having a hub and spiral impeller blades extending generally radially outwardly from said hub and generally spiralling outwardly in a direction opposite to the operational direction of rotation of said impeller, said impeller blades being flexible such that when said motor starts to rotate said impeller in a direction opposite to said operational direction, said impeller blades are flexed and extended radially outwardly at least 2% of the radial length of said impeller blades.

2. Pumping apparatus according to claim 1 wherein said housing has an inner cylindrical wall, said impeller blades having an operational state which is the state of the impeller blades when said impeller blades rotate in said operational direction, said impeller blades having outer radial ends spaced from said inner cylindrical wall of said housing when said impeller blades are in said operational state.

3. Pumping apparatus according to claim 2 wherein when said motor starts to rotate said impeller blades in said opposite direction, said impeller blades are extended radially outwardly such that said outer radial ends of said impeller blades contact said inner cylindrical wall of said housing.

4. Pumping apparatus according to claim 2 further comprising at least one projection extending inwardly from said inner cylindrical wall of said housing, wherein when said motor starts to rotate said impeller blades in said opposite-direction, said impeller blades are extended radially outwardly such that said outer radial ends of said impeller blades engage said projection.

5. Pumping apparatus according to claim 1 wherein said impeller blades have an operational state, which is the state of the impeller blades when said impeller blades rotate in said operational direction and further comprising spacer means disposed between adjacent impeller blades.

6. Pumping apparatus according to claim 5 wherein said impeller blades have a flexed state in which said impeller blades extend radially outwardly at least 2% of the radial length of said impeller blades, said spacer means comprising a projection extending from an impeller blade, said projection having a engaging surface, said engaging surface being spaced from an adjacent impeller blade when said impeller blades are in said flexed state, said engaging surface engaging said adjacent impeller blade when said impeller blades are in said operational state.

7. Pumping apparatus according to claim 6 wherein said impeller blades have a leading surface and a trailing surface, said leading surface leading said trailing surface when said impeller blades rotate in said operational direction, said projection extending from said trailing surface of said impeller blade.

8. Pumping apparatus according to claim 7 wherein said engaging surface of said projection engages a trailing surface of an adjacent impeller blade when said impeller blades are in said operational state.

9. Pumping apparatus according to claim 5 wherein said impeller blades have a flexed state in which said impeller blades extend radially outwardly at least 2% of the radial length of said impeller blades, said spacer means comprising a spacer disposed between two adjacent blades, said spacer having a spacer surface which engages one of said impeller blades when said impeller blades are in said operational state, said spacer surface being spaced from said one impeller blade when said impeller blades are in said flexed state.

10. Pumping apparatus according to claim 9 wherein said spacer surface has a spiral configuration, said impeller blade having a spiral surface which is engaged by said spirally configured spacer surface, said spirally configured spacer surface being complementary to said spiral surface of said impeller blade.

11. Pumping apparatus according to claim 9 further comprising connecting means connecting said spacer to said hub, said spacer extending generally spirally and radially outwardly from said hub.

12. Pumping apparatus according to claim 5 wherein said spacer means comprise laminar spacers which are disposed in the rotational path of the impeller.

13. Pumping apparatus according to claim 1 further comprising a freewheeling clutch between said impeller and said motor, said freewheeling clutch allowing the impeller and motor to be rotated independently of one another for a limited angle of rotation.

14. Pumping apparatus according to claim 13 wherein said limited angle of rotation is greater than 120 degrees in either rotational direction.

15. Pumping apparatus according to claim 1 wherein said housing comprises a spiral housing.

16. Pumping apparatus according to claim 1 wherein said motor comprises an enclosure means enclosing a space in which said rotor is disposed, said space being a wet space in communication with said housing, said stator being disposed outside of said enclosure means, said enclosure means sealing said stator from said wet space.

17. Pump apparatus comprising a centrifugal pump, an electric motor axially aligned with said centrifugal pump, said electric motor comprising a permanent magnet rotor, said centrifugal pump comprising a housing and an impeller rotatable in said housing, said impeller having spiral impeller blades extending generally radially outwardly and generally spiralling outwardly in a direction oppposite to the operational direction of rotation of said impeller, said impeller blades being flexible such that when said motor starts to rotate said impeller blades in a direction opposite to said operational direction, said impeller blades are flexed and extended further radially outwardly at least 2% relative to the radial length of said impeller blades when the impeller blades are at stand still.

18. Pump apparatus according to claim 17 wherein said impeller blades having an operational state, which is the state of the impeller blades when said impeller blades rotate in said operational direction, said impeller blades having a natural unflexed state when said impeller blades are at stand still, the radial length of said impeller blades being shorter when in said operational state than the radial length of said impeller blades when in said natural unflexed state.

* * * * *